US008618862B2

(12) United States Patent
Nadimpalli et al.

(10) Patent No.: US 8,618,862 B2
(45) Date of Patent: Dec. 31, 2013

(54) ANALOG DIVIDER

(75) Inventors: Praveen Varma Nadimpalli, Chandler, AZ (US); Joseph Hubert Colles, Bonsall, CA (US)

(73) Assignee: RF Micro Devices, Inc., Greensboro, NC (US)

( * ) Notice: Subject to any disclaimer, the term of this patent is extended or adjusted under 35 U.S.C. 154(b) by 26 days.

(21) Appl. No.: 13/047,361

(22) Filed: Mar. 14, 2011

(65) Prior Publication Data

US 2012/0154042 A1 Jun. 21, 2012

Related U.S. Application Data

(60) Provisional application No. 61/424,913, filed on Dec. 20, 2010.

(51) Int. Cl.
*G06G 7/16* (2006.01)

(52) U.S. Cl.
USPC ..... 327/356; 327/103; 708/835

(58) Field of Classification Search
USPC ..... 327/103, 355–360; 708/835, 844
See application file for complete search history.

(56) References Cited

U.S. PATENT DOCUMENTS

| | | | | |
|---|---|---|---|---|
| 4,999,521 | A * | 3/1991 | Rusznyak | 327/69 |
| 5,774,013 | A | 6/1998 | Groe | |
| 6,348,834 | B1 * | 2/2002 | Brown | 327/543 |
| 6,522,175 | B2 * | 2/2003 | Ueno et al. | 327/103 |
| 6,819,093 | B1 | 11/2004 | Kay | |
| 2003/0005018 | A1 * | 1/2003 | Kawauchi | 708/835 |
| 2011/0140758 | A1 * | 6/2011 | Shih | 327/356 |
| 2012/0154015 | A1 * | 6/2012 | Nadimpalli et al. | 327/358 |

FOREIGN PATENT DOCUMENTS

| | | | | |
|---|---|---|---|---|
| JP | 56016240 A | * | 2/1981 | G06F 7/16 |
| JP | 56016267 A | * | 2/1981 | G06G 7/16 |

OTHER PUBLICATIONS

Hadgis, G.A. et al., "A novel CMOS monolithic analog multiplier with wide input dynamic range," Proceedings of the 8th International Conference on VLSI Design, Jan. 4-7, 1995, pp. 310-314, IEEE.
Non-final Office Action for U.S. Appl. No. 13/047,211 mailed Sep. 17, 2012, 20 pages.
Final Office Action for U.S. Appl. No. 13/047,211 mailed Dec. 31, 2012, 9 pages.
Advisory Action for U.S. Appl. No. 13/047,211 mailed Mar. 7, 2013, 3 pages.
Non-Final Office Action for U.S. Appl. No. 13/047,211, mailed May 1, 2013, 12 pages.
Notice of Allowance for U.S. Appl. No. 13/047,211, mailed Aug. 30, 2013, 11 pages.

* cited by examiner

*Primary Examiner* — Patrick O'Neill
(74) *Attorney, Agent, or Firm* — Withrow & Terranova, P.L.L.C.

(57) ABSTRACT

An exemplary embodiment of an analog multiplier may include a voltage controlled resistance circuit, a first transistor and a second transistor, where the resistance of the voltage controlled resistance circuit is based upon a difference between a supply voltage and a first input voltage and a constant current supply. The current passing through the voltage controlled resistance circuit is based upon a difference between the voltage supply and a second input voltage. The first transistor may be configured to mirror the current passing through the voltage controlled resistance circuit.

16 Claims, 6 Drawing Sheets

ANALOG DIVIDER

RELATED APPLICATIONS

This application claims the benefit of U.S. provisional patent application No. 61/424,913, entitled "Analog Multiplier," filed on Dec. 20, 2010, the disclosure of which is incorporated herein by reference in its entirety. This application is related to a concurrently filed U.S. non-provisional patent application Ser. No. 13/047,211, entitled "Analog Multiplier," filed on Mar. 14, 2011, the disclosure of which is incorporated herein by reference in its entirety.

FIELD OF THE DISCLOSURE

Embodiments described herein relate to an analog multiplier circuit. In addition, the embodiments described herein are further related to use of an analog multiplier to generate one or more controlled currents based upon a first input voltage and a second input voltage.

BACKGROUND

Analog multipliers may be used to multiply two analog signals to produce an output, which is effectively the product of the analog signals. In some cases, an analog multiplier may be used to multiply a first analog signal by the inverse of a second analog signal. The output of an analog multiplier may be either a voltage or a current.

Some analog multipliers may use two diodes to generate a current, which is an exponential function of the two input voltages. As a result, any offset voltage from the two input voltages may be exponentially magnified. In addition, the exponential function of the diodes tends to be sensitive to both process variations and temperature variations. As a result, the output of an analog multiplier may vary with process.

These process variations may affect the accuracy of the analog multiplier and lead to poor manufacturing yields or result in the need for post manufacturing calibration. Accordingly, there is a need for a new analog multiplier circuit or technique that substantially reduces or eliminates the process and batch to batch variations in an output of an analog multiplier.

SUMMARY

The embodiments described in the detailed description relate to process independent analog multipliers used to generate a process independent controlled current source. A first field effect transistor and a second field effect transistor are controlled to operate in a triode region of operation. A first fixed resistor may be coupled to the drain of the first field effect transistor. A first operational amplifier is configured to receive a first reference voltage, where the operational amplifier regulates the voltage across the first fixed resistor and the drain-to-source resistance of the first field effect transistor to be substantially equal to the supply voltage less the first voltage. A constant current source coupled to the first resistor provides a reference current to pass through the first resistor and drain-to-source resistance of the first field effect transistor.

A second field effect transistor is also controlled to operate in the triode region of operation and to have substantially the same drain-to-source impedance as the first field effect transistor. A control node of the second field effect transistor is coupled to a control node of the first field effect transistor. The resistance of the first resistor may equal the resistance of the second resistor. A second resistor may be coupled to the drain of the second field effect transistor. As a result, the combined resistance of the second resistor and the drain-to-source resistance of the second field effect transistor may be substantially equal to the combined resistance of the drain-to-source resistance of the first field effect transistor and the resistance of the first resistor.

A second operational amplifier may be configured to regulate a second control voltage and may be placed across the combined resistance of the second resistor and the drain-to-source resistance of the second field effect transistor. As a result, the drain current of the second field effect transistor is substantially equal to the reference current multiplied by a ratio of the supply voltage less the second voltage divided by the supply voltage less the first voltage. A current mirror coupled to the output of the second operational amplifier provides an output current substantially equal to the drain current of the second field effect transistor.

A first exemplary embodiment of an analog multiplier includes a voltage controlled resistance circuit, a first operational amplifier, and a first transistor. The voltage controlled resistance circuit may include a first node, a second node coupled to a supply voltage, and a control node coupled to a first input voltage. The voltage controlled resistance circuit may further include a reference current source configured to provide a reference current. The impedance between the first node and second node of the voltage controlled resistance circuit may be based upon a ratio of the supply voltage less the first input voltage divided by the reference current. The first operational amplifier may include an inverted input coupled to a second input voltage, a non-inverted input coupled to the first node of the voltage controlled resistance circuit, and an output node. The first transistor may include a gate in communication with the output node of the first operational amplifier, a source coupled to a reference voltage, and a drain coupled to the non-inverted input of the first operational amplifier and the first node of the voltage controlled resistance circuit.

Another exemplary embodiment of an analog multiplier may be a method including generating a reference current, wherein the reference current passes through a first element. A first voltage generated across the first element is controlled to set a resistance of the first element based upon a first input voltage. A resistance of a second element is controlled to be substantially equal to the resistance of the first element. A second voltage generated across the second element is controlled based upon a second input voltage to generate a current passing through a third element.

Those skilled in the art will appreciate the scope of the disclosure and realize additional aspects thereof after reading the following detailed description in association with the accompanying drawings.

BRIEF DESCRIPTION OF THE DRAWINGS

The accompanying drawings incorporated in and forming a part of this specification illustrate several aspects of the disclosure, and together with the description serve to explain the principles of the disclosure.

DETAILED DESCRIPTION

The embodiments set forth below represent the necessary information to enable those skilled in the art to practice the disclosure and illustrate the best mode of practicing the disclosure. Upon reading the following description in light of the accompanying drawings, those skilled in the art will understand the concepts of the disclosure and will recognize applications of these concepts not particularly addressed herein. It should be understood that these concepts and applications fall within the scope of the disclosure and the accompanying claims.

The embodiments described herein relate to process independent analog multipliers used to generate a process independent controlled current source. A first field effect transistor and a second field effect transistor are controlled to operate in a triode region of operation. A first fixed resistor may be coupled to the drain of the first field effect transistor. A first operational amplifier is configured to receive a first reference voltage, where the operational amplifier regulates the voltage across the first fixed resistor and the drain-to-source resistance of the first field effect transistor to be substantially equal to the supply voltage less the first voltage. A constant current source coupled to the first resistor provides a reference current to pass through the first resistor and drain-to-source resistance of the first field effect transistor.

A second field effect transistor is also controlled to operate in the triode region of operation and to have substantially the same drain-to-source impedance as the first field effect transistor. A control node of the second field effect transistor is coupled to a control node of the first field effect transistor. The resistance of the first resistor may equal the resistance of the second resistor. A second resistor may be coupled to the drain of the second field effect transistor. As a result, the combined resistance of the second resistor and the drain-to-source resistance of the second field effect transistor may be substantially equal to the combined resistance of the drain-to-source resistance of the first field effect transistor and the resistance of the first resistor.

A second operational amplifier may be configured to regulate a second control voltage and may be placed across the combined resistance of the second resistor and the drain-to-source resistance of the second field effect transistor. As a result, the drain current of the second field effect transistor is substantially equal to the reference current multiplied by a ratio of the supply voltage less the second voltage divided by the supply voltage less the first voltage. A current mirror coupled to the output of the second operational amplifier provides an output current substantially equal to the drain current of the second field effect transistor.

Figure 1:
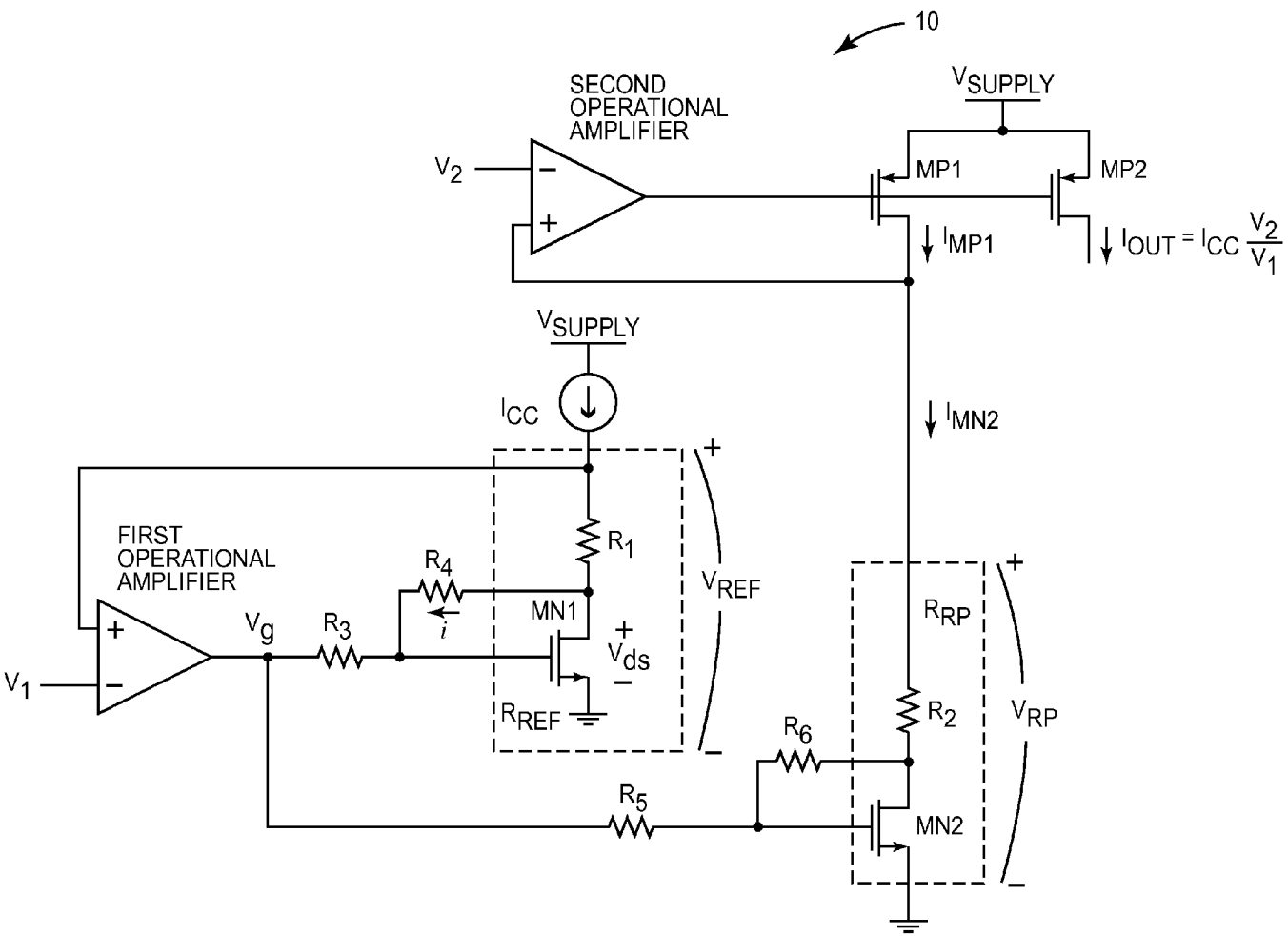
FIG. 1 depicts an exemplary embodiment of an analog multiplier referenced to a constant current source.

FIG. 1 depicts an exemplary embodiment of an analog multiplier 10, where the output current $I_{OUT}$ is substantially based upon a current of a constant current source $I_{CC}$ and the ratio of a second input voltage $V_2$ to a first input voltage $V_1$.

The analog multiplier 10 includes a first controlled resistance $R_{REF}$ and a second controlled resistance $R_{RP}$. The impedance of the first controlled resistance $R_{REF}$ equals the resistance of a first resistor $R_1$ plus a drain-to-source resistance $R_{MN1}$ of a first transistor MN1. A source of the first transistor MN1 is coupled to a reference voltage, ground, while the drain of the first transistor is coupled to the first resistor $R_1$. The resistance of the second controlled resistance $R_{RP}$ equals a resistance of a second resistor $R_2$ plus a drain-to-source resistance $R_{MN2}$ of a second transistor MN2. A source of the second transistor MN2 is coupled to a reference voltage, ground, while the drain of the second transistor is coupled to the second resistor $R_2$. The drain-to-source resistance $R_{MN1}$ of the first transistor MN1, operating in a triode mode region of operation, is provided by equation (1).

$$R_{MN1} = \frac{1}{K_{MN1}(V_{gs_{MN1}} - V_t - V_{ds_{MN1}}/2)}, \tag{1}$$

where $V_{gs_{MN1}}$ is the gate-to-source voltage of the first transistor MN1, $V_t$ is the threshold voltage of the first transistor MN1, $V_{ds_{MN1}}$ is the drain-to-source voltage across the first transistor MN1, and $K_{MN1}$ is a constant. The value of $K_{MN1}$ for a NMOS FET transistor may be calculated as given in equation (2).

$$K_{MN1} = \mu_n C_{ox}\left(\frac{W_{MN1}}{L_{MN1}}\right), \tag{2}$$

where $L_{MN1}$ is the channel length of the first transistor MN1, $W_{MN1}$ is the channel width of the first transistor MN1, $\mu_{MN1}$ is the mobility of an electron in a material of the first transistor MN1, and $C_{ox}$ is the gate oxide capacitance per unit area of the first transistor MN1.

As indicated by equation (1), the drain-to-source impedance of the first transistor is dependent upon the drain-to-source voltage $V_{ds_{MN1}}$ of the first transistor. The non-linear effects of the drain-to-source voltage $V_{ds_{MN1}}$ on the impedance across the FET transistor may be compensated for by a first linearization circuit composed of a third resistor $R_3$ and a fourth resistor $R_4$, for the first transistor MN1; and a second linearization circuit composed of a fifth resistor $R_5$ and a sixth resistor $R_6$, for the second transistor MN2.

The third resistor $R_3$ is coupled between the output of a first operation amplifier $OPAMP_1$ and the gate of the first transistor MN1. The fourth resistor $R_4$ is coupled between the gate and drain of the first transistor MN1. The fifth resistor $R_5$ is coupled between the output of the first operational amplifier $OPAMP_1$ and the gate of the second transistor MN2. The sixth resistor $R_6$ is coupled between the gate and drain of the second transistor MN2.

The first operational amplifier $OPAMP_1$ generates a gate control voltage $V_g$ based upon the difference between a first input voltage $V_1$, applied to the inverting input of the $OPAMP_1$ and the voltage $V_{REF}$ across the first controlled resistance $R_{REF}$. The gate-to-source voltage $V_{gs_{MN1}}$ of the first transistor MN1 is given by equation (3), where the gate current is assumed to be zero relative to the current "i" passing through resistors $R_3$ and $R_4$.

$$V_{gs_{MN1}} = V_g - iR_3 \tag{3}$$

The voltage $V_{ds_{MN1}}$ of the first transistor MN1 is given by equation (4).

$$V_{ds_{MN1}} = V_g - i(R_3 + R_4) \tag{4}$$

Setting the resistance of $R_3$ and $R_4$ to R, re-arranging variables, and solving for $V_{gs_{MN1}}$ of the first transistor MN1 yields equation (5).

$$V=(V_g-V_{ds_{MN1}})/2 \quad (5),$$

where $V_g$ is a gate control voltage at the output of the operational amplifier $OPAMP_1$, and $V_{ds_{MN1}}$ is the drain-to-source voltage of the first transistor MN1.

Substituting equation (5) into equation (1) yields a "linearized" equation (6) for the drain-to-source resistance $R_{MN1}$ of the first transistor MN1 that is not dependent upon the drain-to-source voltage $V_{ds_{MN1}}$ of the first transistor MN1.

$$R_{MN1} = \frac{1}{K_{MN1}[V_g/2 - V_t]} \quad (6)$$

Assuming that a resistance of the fifth resistor $R_5$ equals the resistance of the sixth resistor $R_6$, a similar result is reached for the drain-to-source resistance of the second transistor MN2, which is given by equation (7).

$$R_{MN2} = \frac{1}{K_{MN2}[V_g/2 - V_t]} \quad (7)$$

Assuming that the first transistor MN1 and the second transistor MN2 have the same threshold voltage $V_t$, the ratio of the drain-to-source resistance of the first transistor MN1 to the drain-to-source resistance of the second transistor MN2 is shown in equation (8).

$$\frac{R_{MN1}}{R_{MN2}} = \frac{K_{MN2}}{K_{MN1}} = \frac{(L_{MN1} \times W_{MN2})}{(L_{MN2} \times W_{MN1})} \quad (8)$$

where $L_{MN2}$ is the channel length of the second transistor MN2, and $W_{MN2}$ is the channel width of the second transistor MN2.

Accordingly, using the same channel length and channel width for both the first transistor MN1 and the second transistor MN2 sets the drain-to-source resistance $R_{MN2}$ of the second transistor MN2 equal to the drain-to-source resistance $R_{MN1}$ of the first transistor MN1. Alternatively, the channel length and channel width of the first transistor MN1 may be different than the channel length and channel width of the second transistor MN2 such that the drain-to-source resistance $R_{MN1}$ of the first transistor MN1 is proportional to the drain-to-source resistance $R_{MN2}$ of the second transistor MN2.

As an example, in some exemplary embodiments of the analog multiplier the drain-to source resistance $R_{MN2}$ of the second transistor MN2 may be a factor "n" times the drain-to-source resistance $R_{MN1}$ of the first transistor MN1. In other embodiments, the resistance of the second resistor $R_2$ is also the factor "n" times the resistance of the first resistor $R_1$ such that the combined resistance of the drain-to-source resistance $R_{MN2}$ of the second transistor and the resistance of the second resistor $R_2$ is the factor of "n" times the combined resistance of the of the drain-to-source resistance $R_{MN1}$ of the first transistor and the resistance of the first resistor. In some embodiments the factor "n" is greater than one. In other embodiments the factor "n" may be less than one.

A constant current source $I_{CC}$ is coupled between the first resistor $R_1$ and a supply voltage $V_{SUPPLY}$. The voltage generated across the first controlled resistance $R_{REF}$, ($V_{REF}$), is controlled based upon the first input voltage $V_1$ divided by the current passing through the constant current source $I_{CC}$, where the voltage drop across the inverting input of the first operational amplifier $OPAMP_1$ and the non-inverting input of the first operational amplifier $OPAMP_1$ is assumed to approach zero volts.

Accordingly, the resistance of the first controlled resistance $R_{REF}$ is given by equation (9), where $V_1$ is a first control voltage.

$$R_{REF} = \frac{V_{REF}}{I_{CC}} = \frac{V_1}{I_{CC}} \quad (9)$$

The analog multiplier 10 further includes a second operational amplifier $OPAMP_2$ having an inverting input coupled to a second control voltage $V_2$, and a non-inverting input coupled to the second controlled resistance $R_{RP}$. A drain of a third transistor MP1 is also coupled to the non-inverting input of the second operational amplifier $OPAMP_2$. The source of the third transistor MP1 is coupled to the supply voltage $V_{SUPPLY}$. The gate of the third transistor MP1 is coupled to the output of the second operational amplifier $OPAMP_2$.

A second input voltage $V_2$ is provided to the inverting input of the second operational amplifier $OPAMP_2$. Assuming that the voltage drop across the inverting input of the second operational amplifier $OPAMP_2$ and the non-inverting input of the second operational $OPAMP_2$ approaches zero volts, the second input voltage $V_2$ is placed across the second controlled resistance $R_{RP}$. Assuming that the current passing through the sixth resistor $R_6$ is more than an order of magnitude less than the drain current of the second transistor $I_{MN2}$, the current passing through the second controlled resistance $R_{RP}$ ($I_{MN2}$) is given by equation (10).

$$I_{MN2} \cong \frac{V_2}{R_{MN2} + R_2} \quad (10)$$

Setting the resistance of the first resistor $R_1$ equal to the resistance of the second resistor $R_2$ such that $R_{REF}$ equals $R_{RP}$ yields equation (11), where $R_{MN1}$ equals $R_{MN2}$.

$$I_{MN2} = \left[\frac{V_2}{V_1}\right] \times I_{CC} \quad (11)$$

Assuming that the input impedance of the second operational amplifier $OPAMP_2$ is very large, the drain current $I_{MP1}$ of the third transistor MP1 equals the drain current $I_{MN1}$ of the second transistor MN2. A fourth transistor MP2 mirrors the drain current $I_{MP1}$ of the third transistor MP1. The fourth transistor MP2 includes a source coupled to the voltage supply $V_{SUPPLY}$ and a gate coupled to the output of the second operational amplifier $OPAMP_2$. As a result, the output current $I_{OUT}$ passing through the fourth transistor MP2 is equal to the drain current $I_{MP1}$ passing through the third transistor MP1. In some embodiments of the analog multiplier 10 the fourth transistor MP2 may be configured to have an output current $I_{OUT}$ proportional to the drain current passing through the third transistor MP1. Accordingly, the output current $I_{OUT}$ is given by equation (12).

$$I_{OUT} = \left[\frac{V_2}{V_1}\right] \times I_{CC} \tag{12}$$

In an alternative embodiment, the resistance of the first resistor and the second resistor are set to zero. In this case, the output current $I_{OUT}$ may be based upon the ratio of the drain-to-source resistance $R_{MN1}$ of the first transistor MN1 to the drain-to-source resistance $R_{MN2}$ of the second transistor MN2, as shown in equation (13).

$$I_{MN2} = \left[\frac{V_2}{R_{MN2}}\right] = \left[\frac{V_2}{V_1}\right] \times \frac{(L_{MN1} \times W_{MN2})}{(L_{MN2} \times W_{MN1})} \times I_{CC} \tag{13}$$

Accordingly, the output current $I_{OUT}$ is given by equation (14), which permits the output current to be scaled according to the relative channel length to channel width ratios of the first transistor MN1 and the second transistor MN2.

$$I_{OUT} = \left[\frac{V_2}{V_1}\right] \times \frac{(L_{MN1} \times W_{MN2})}{(L_{MN2} \times W_{MN1})} \times I_{CC} \tag{14}$$

Figure 2:
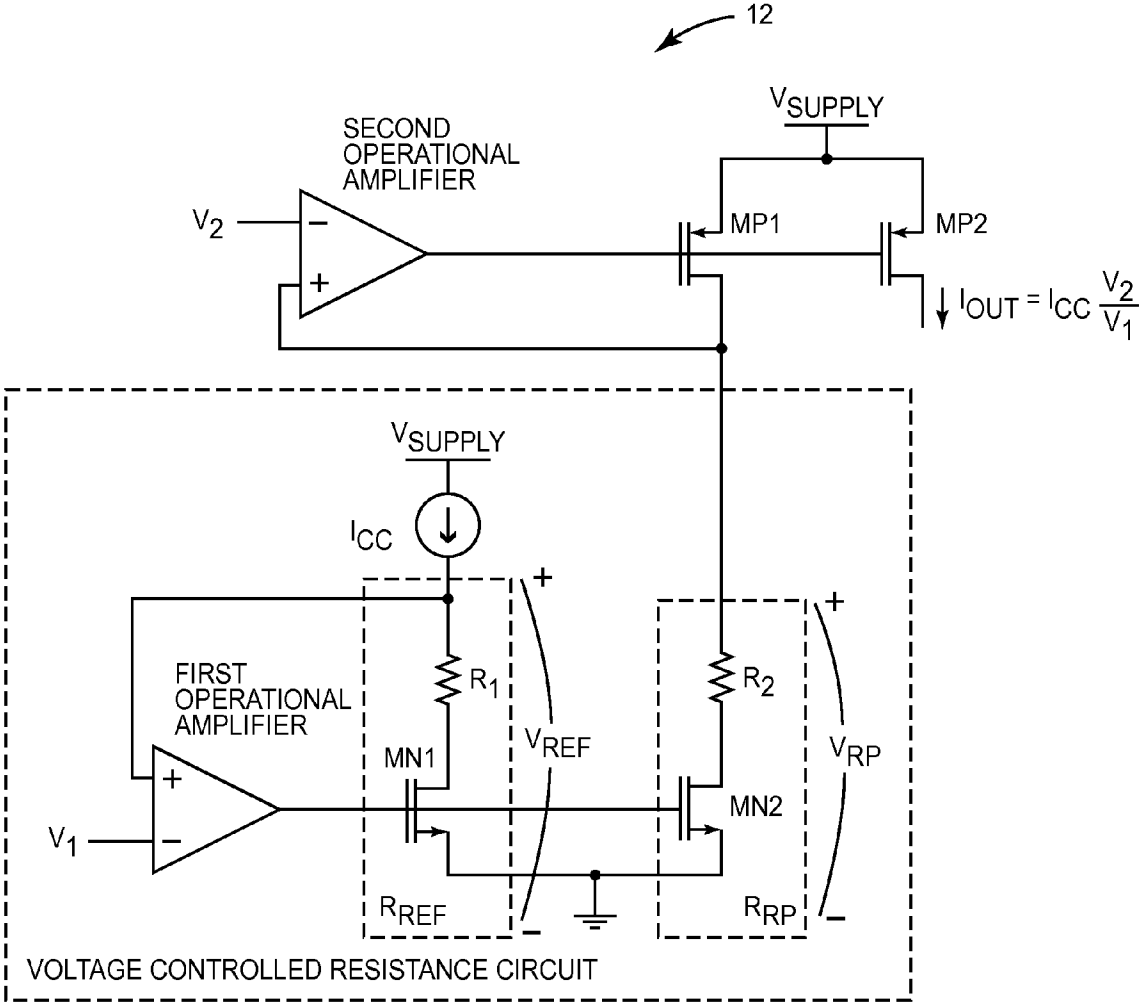
FIG. 2 depicts a second exemplary embodiment of an analog multiplier referenced to a constant current source.

FIG. 2 depicts another exemplary embodiment of an analog multiplier 12, which is similar in function to the analog amplifier 10 depicted in FIG. 1. As depicted in FIG. 2, the first linearization circuit and the second linearization circuit are eliminated. The gates of the first transistor MN1 and the second transistor MN2 are directly tied to the output of the first operational amplifier. In addition, the fourth resistor $R_4$ and the sixth resistor $R_6$ are removed. Accordingly, the resistance of the first controlled resistance $R_{REF}$ is given by equation (15).

$$R_{REF} = \frac{1}{K_{MN1}(V_{gs_{MN1}} - V_t - V_{ds_{MN1}}/2)} + R_1 \tag{15}$$

where $V_{ds_{MN1}}$ is the drain-to-source voltage across the first transistor MN1, and $V_{gs_{MN1}}$ is the gate-to-source voltage of the second transistor MN1.

Similarly, the resistance of the second controlled resistance $R_{RP}$ is given by equation (16).

$$R_{RP} = \frac{1}{K_{MN2}(V_{gs_{MN2}} - V_t - V_{ds_{MN2}}/2)} + R_2 \tag{16}$$

where $V_{ds_{MN2}}$ is the drain-to-source voltage across the first transistor MN2, and $V_{gs_{MN2}}$ is the gate-to-source voltage of the second transistor MN2. The gate-to-source voltage $V_{gs_{MN1}}$ of the first transistor MN1 and the gate-to-source voltage $V_{gs_{MN2}}$ of the second transistor MN2 are each equal to $V_g$. When the first input voltage $V_1$ equals the second input voltage $V_2$, the drain-to-source resistance $R_{MN1}$ of the first transistor MN1 equals the drain-to-source resistance $R_{MN2}$ of the second transistor MN2. Otherwise, the drain-to-source resistance $R_{MN1}$ of the first transistor MN1 does not equal the drain-to-source resistance $R_{MN2}$ of the second transistor MN2 because $V_{ds_{MN1}} \neq V_{ds_{MN2}}$. The difference between the drain-to-source resistance $R_{MN1}$ of the first transistor MN1 and the drain-to-source resistance $R_{MN2}$ of the second transistor MN2 may be calculated based upon the ratio of $R_{MN1}$ divided by $R_{MN2}$, as shown in equation (17), where $$\left[\frac{R_{MN1}}{R_{MN2}}\right] = 1 + \frac{K(V_{ds_{MN1}} - V_{ds_{MN2}})}{2 \times I_{CC}} V_{DS_{MN1}} \tag{17}$$

where $K_{MN1}$ and $K_{MN2}$ are the same and $$V_{gs_{MN1}} - V_t = V_g - V_t = \frac{I_{CC}}{K \times V_{ds_{MN1}}} + V_{ds_{MN1}}/2 \tag{17.b}$$

which yields an error factor λ given as equation (17.c).

$$\lambda = \frac{K(V_{ds_{MN1}} - V_{ds_{MN2}})}{2 \times I_{CC}} V_{DS_{MN1}} \tag{17.c}$$

Accordingly, the error factor λ, by which $R_{MN1}$ does not equal $R_{MN2}$, may be minimized by minimizing the difference between the $V_{ds_{MN1}}$ and $V_{ds_{MN2}}$ or increasing the current output of the constant current source $I_{CC}$ relative to the value of K.

In an alternative exemplary embodiment, a first linearizing resistor (not shown) may be placed across the drain-to-source terminals of the first transistor MN1 and a second linearizing resistor (not shown) may be placed across the drain-to-source terminals of the second transistor MN2.

Figure 3:
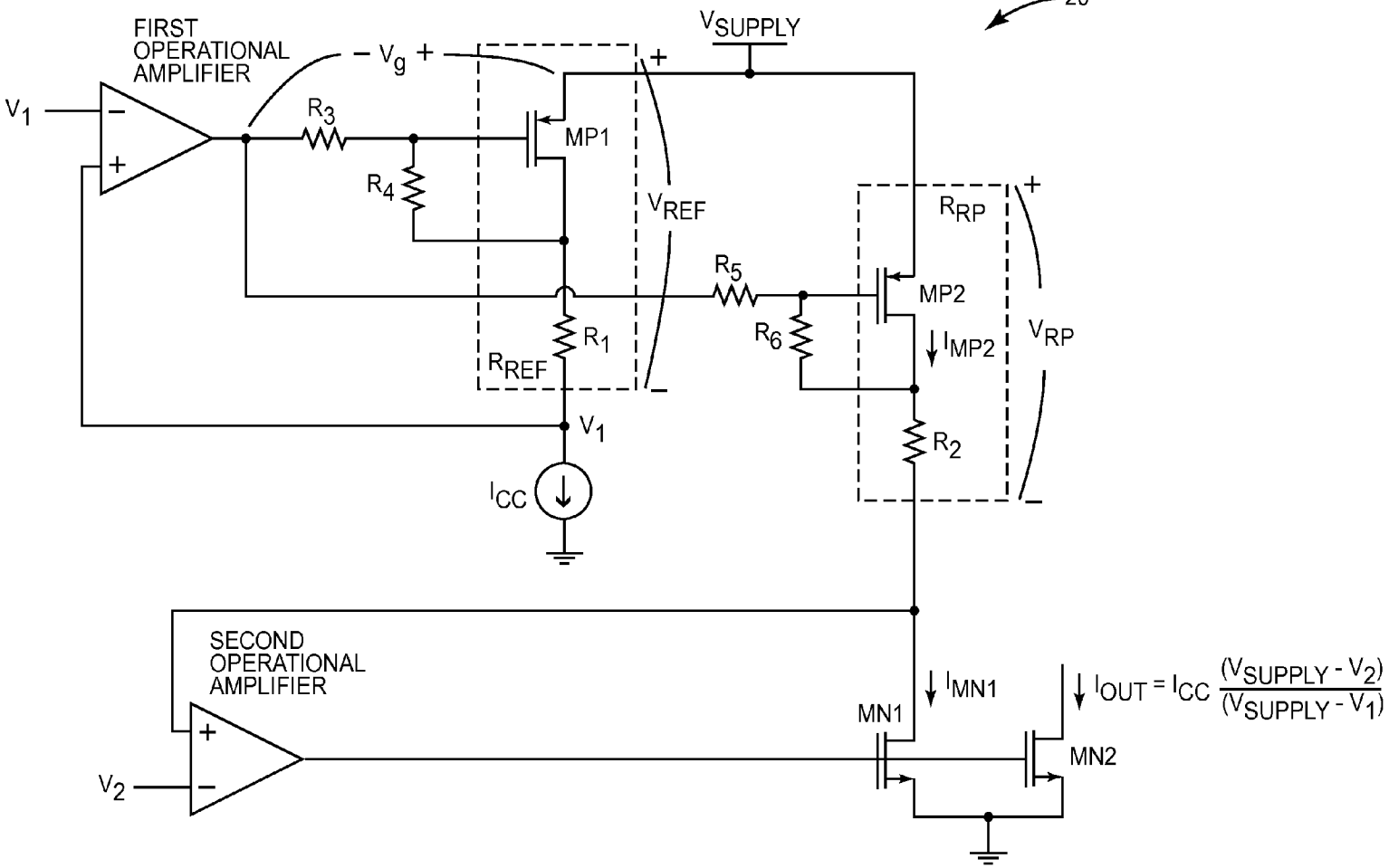
FIG. 3 depicts a third exemplary embodiment of an analog multiplier referenced to a constant current source.

FIG. 3 depicts an exemplary embodiment of an analog multiplier 20 referenced to a constant current source $I_{CC}$. Similar to the analog multiplier 10 of FIG. 1, the analog multiplier 20 includes a first controlled resistance $R_{REF}$ coupled between the supply voltage $V_{SUPPLY}$ and the constant current source $I_{CC}$. The first controlled resistance $R_{REF}$ includes the drain-to-source resistance $R_{MP1}$ of the first transistor MP1 and resistance of the first resistor $R_1$. The analog multiplier 20 further includes a second controlled resistance $R_{RP}$, which includes the drain-to-source resistance $R_{MP2}$ of the second transistor MP2 and the resistance of a second resistor $R_2$. The second controlled resistance $R_{RP}$ is coupled between the voltage supply $V_{SUPPLY}$ and the drain of a third transistor MN1. The source of the third transistor MN1 is coupled to a reference voltage, which may be ground. A fourth transistor MN2 is configured to mirror the drain current of the third transistor MN1. The source of the fourth transistor MN2 is coupled to the reference voltage, which may be ground.

Similar to analog multiplier 10 of FIG. 1, the analog multiplier 20 includes a first operational amplifier $OPAMP_1$ having an inverting input coupled to a first input voltage $V_1$, a non-inverting input coupled to the constant current source $I_{CC}$, and an output. The output of the first operational amplifier $OPAMP_1$ is coupled to a first linearization circuit formed by the third resistor $R_3$ and the fourth resistor $R_4$. The third resistor $R_3$ is coupled between the gate of the first transistor MP1 and the output of the first operational amplifier $OPAMP_1$. The fourth resistor $R_4$ is coupled between the gate and drain of the first transistor MP1. The output of the first operational amplifier $OPAMP_1$ is also coupled to a second linearization circuit formed by a fifth resistor $R_5$ and a sixth resistor $R_6$. The fifth resistor $R_5$ is coupled between the gate of the second transistor MP2 and the output of the first operational amplifier $OPAMP_1$. The sixth resistor $R_6$ is coupled between the gate and drain of the second transistor MP2.

Also similar to the analog multiplier 10 of FIG. 1, the drain-to-source resistance $R_{MP1}$ of the first transistor MP1 is given by equation (18), and the drain-to-source resistance $R_{MP2}$ of the second transistor MP2 is given by equation (19).

$$R_{MP1} = \frac{1}{K_{MP1}[V_g/2 - V_t]} \tag{18}$$

$$R_{MP2} = \frac{1}{K_{MP2}[V_g/2 - V_t]} \tag{19}$$

where $V_g$ is the voltage between the output of the first operational amplifier $OPAMP_1$ and the sources of the first transistor MP1 and the second transistor MP2.

Also similar to the analog multiplier 10 of FIG. 1, the analog multiplier 20 of FIG. 3 further includes a second operational amplifier $OPAMP_2$ having an inverting output coupled to a second input voltage $V_2$, a non-inverting input coupled to the second resistor $R_2$, and an output coupled to the gate of the third transistor MN1.

The resistance of the first controlled resistance $R_{REF}$ is given by equation (20), where $V_1$ is the first control voltage.

$$R_{REF} = \frac{V_{REF}}{I_{CC}} = \frac{V_{SUPPLY} - V_1}{I_{CC}} \tag{20}$$

Assuming that the resistance of the first resistor $R_1$ equals the resistance of the second resistance $R_2$ and that $K_{MP1}=K_{MP2}$, the drain current of the second transistor MP2 is given by equation (21).

$$I_{MP2} = \left[\frac{V_{SUPPLY} - V_2}{V_{SUPPLY} - V_1}\right] \times I_{CC} \tag{21}$$

Assuming that the current passing through the sixth resistor $R_6$ is minimal compared to the drain current $I_{MP2}$ of the second transistor MP2, the drain current $I_{MN1}$ of the third transistor MN1 is substantially equal to the drain current $I_{MP2}$ of the second transistor MP2. Because the fourth transistor MN2 is configured to mirror the drain current $I_{MN1}$ of the third transistor MN1, the output current $I_{OUT}$ is given by equation (22).

$$I_{OUT} = \left[\frac{V_{SUPPLY} - V_2}{V_{SUPPLY} - V_1}\right] \times I_{CC} \tag{22}$$

Alternatively, a fifth transistor (not shown) may be configured to mirror the current through the second transistor MP2 of FIG. 3 by coupling the gate of the fifth transistor to the gate of the second transistor MP2. In this case, the source of the fifth transistor is coupled to the supply voltage $V_{SUPPLY}$. The drain current of the fifth transistor will be proportional to the drain current of the second transistor MP2 of FIG. 3.

Figure 4:
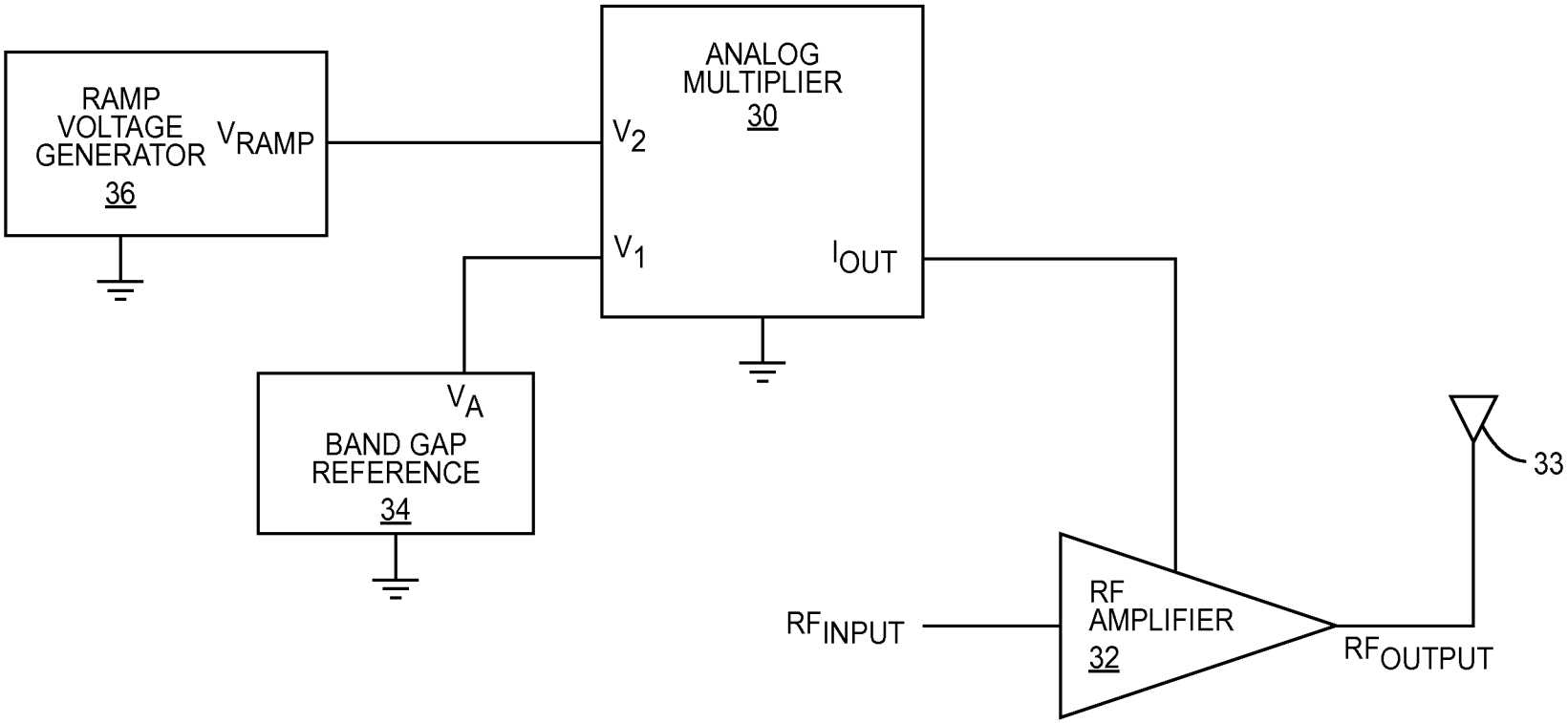
FIG. 4 depicts an exemplary application of the analog multiplier of FIGS. 1-2 to control the operation of a radio frequency power amplifier.

FIG. 4 depicts an exemplary application of the analog multiplier of FIG. 2 to control the operation of a radio frequency power amplifier. The analog multiplier 30 includes a first voltage input $V_1$, a second voltage input $V_2$, and a controlled current output $I_{OUT}$. Assuming that the analog multiplier 30 is similar to the analog amplifier 10 of FIG. 1, the output current $I_{OUT}$ is given by equation (23), $$I_{OUT} = \left[\frac{V_2}{V_1}\right] \times I_{CC} \tag{23}$$

where $I_{CC}$ is a reference current. The reference current $I_{CC}$ may be set by an external resistance (not shown). The controlled current output $I_{OUT}$ may be coupled to the power input of a radio frequency (RF) amplifier 32. The RF amplifier 32 may be configured to receive an RF input and provide an RF output to an antenna 33. The RF amplifier 32 may be a wideband code division multiple access (WCDMA) power amplifier.

A first reference voltage output $V_A$ of a band gap reference 34 is coupled to the first voltage input $V_1$ of the analog multiplier 30. The band gap reference 34 may be configured to provide a substantially temperature invariant control voltage $V_A$. A ramp voltage generator circuit 36 includes a $V_{RAMP}$ output voltage coupled to the second voltage input $V_2$ of the analog multiplier. The ramp voltage generator circuit 36 may include a configurable offset voltage. The $V_{RAMP}$ output voltage may be used to control the output power of the RF amplifier 32.

Figure 5:
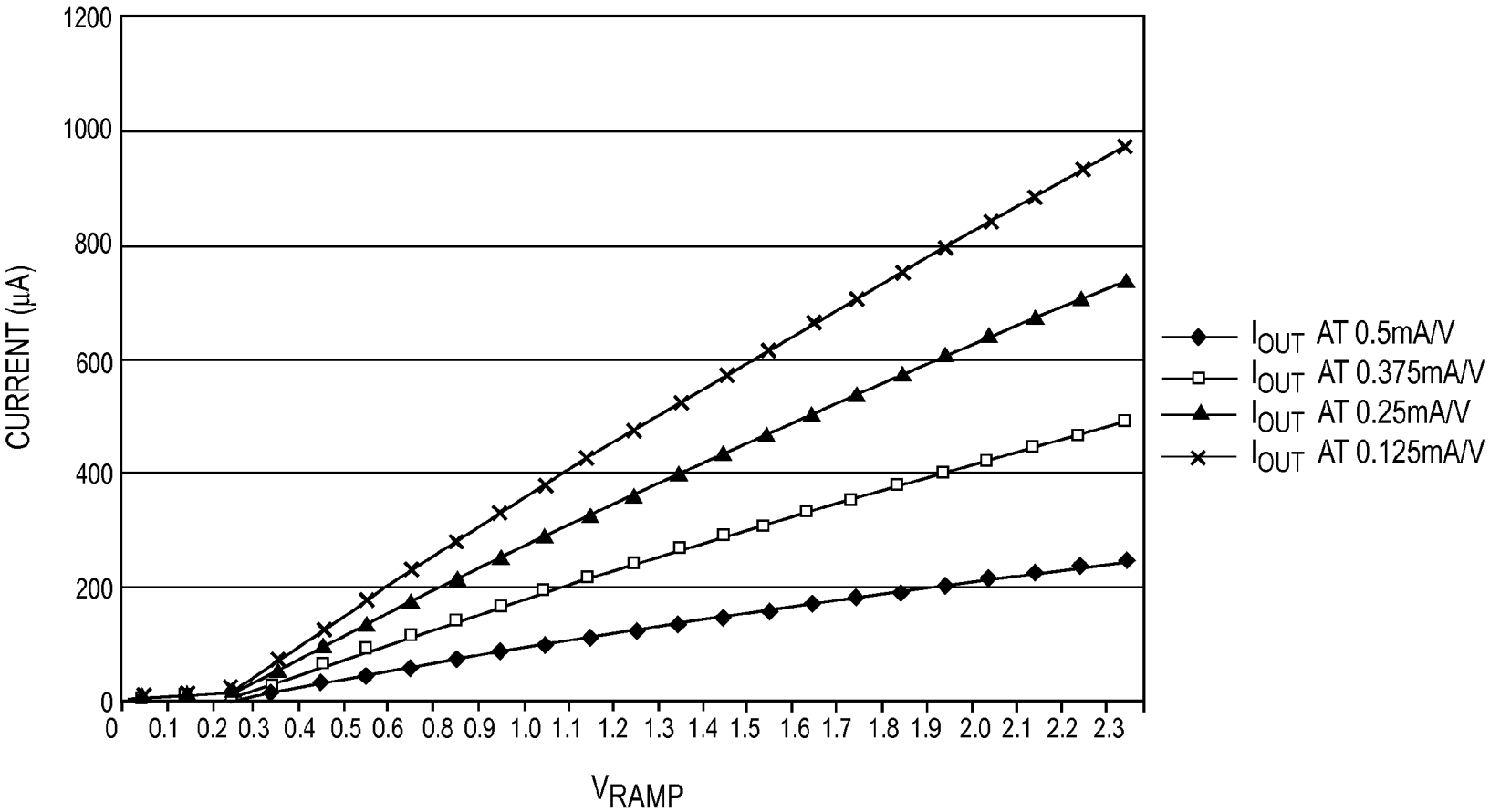
FIG. 5 depicts an exemplary relationship between a controlled current output and a first input voltage and a second input voltage.

FIG. 5 depicts an example relationship between the controlled current output $I_{OUT}$ of the analog multiplier 30 for different values of reference current $I_{CC}$, where the first voltage input $V_1$ is 2.0 volts, and the second voltage output $V_2$ equals ($V_{RAMP}$−0.2 volts), as shown in equation (24).

$$I_{OUT} = \left[\frac{V_{RAMP} - .2V}{2V}\right] \times I_{CC}. \tag{24}$$

Figure 6:
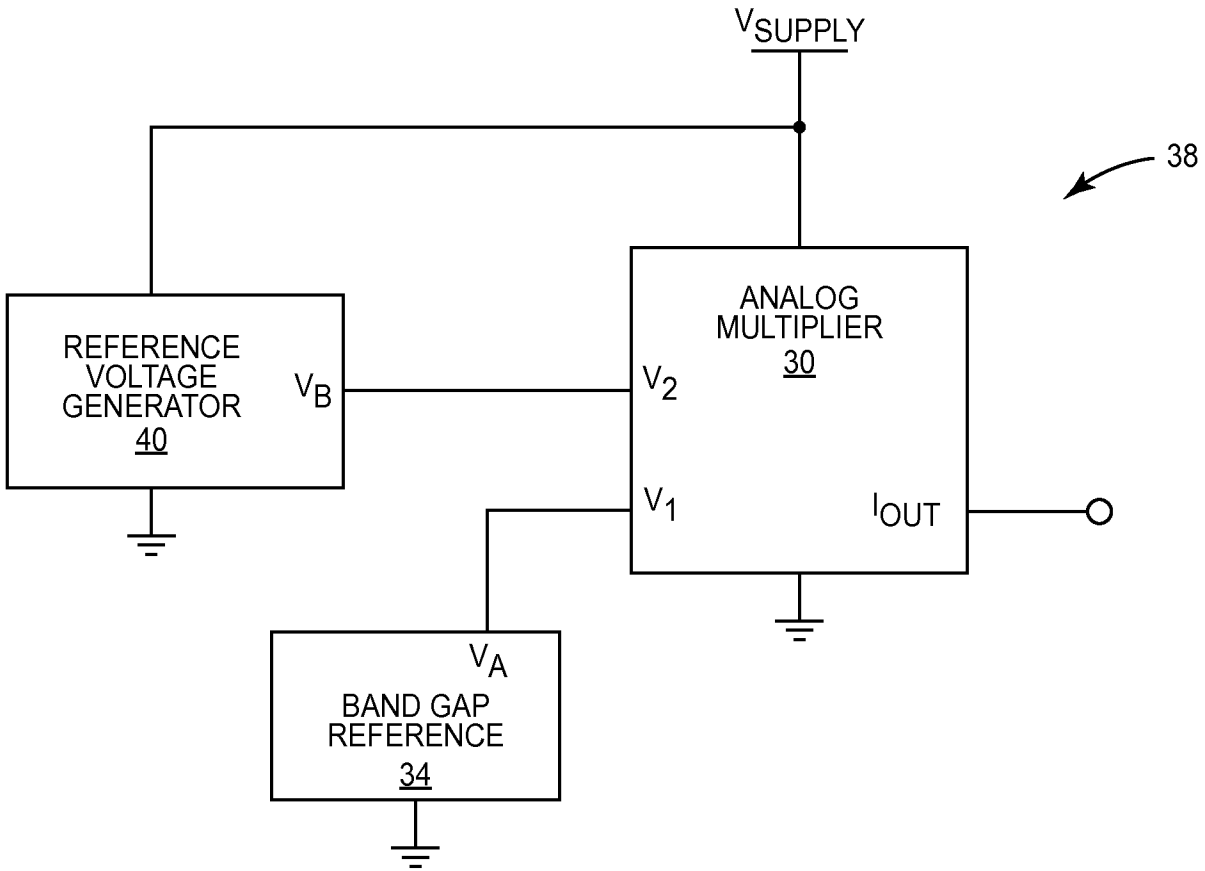
FIG. 6 depicts an exemplary application of the analog multipliers of FIGS. 1-3 to generate either a proportional to absolute temperature current source or an inversely proportional to absolute temperature current source referenced to a constant current source.

As depicted in FIG. 6, the non-linear error factor A for the analog multiplier 12 of FIG. 2 is less than 1%.

FIG. 6 depicts an exemplary application of the analog multiplier of FIGS. 1-2. A reference voltage generator circuit 40 includes an analog multiplier 32, a band gap reference 34, and a reference voltage generator 40. The first input voltage $V_1$ of the analog multiplier 32 may be coupled to the first reference voltage output $V_A$ of the band gap reference 34. The second input voltage $V_2$ of the analog multiplier 32 may be coupled to a reference voltage generator output $V_B$ of the reference voltage generator 40. The reference voltage generator output $V_B$ may be a control voltage. As a non-limiting example, the reference voltage may be a proportional to absolute temperature voltage reference $V_{PTAT}$, an inversely proportional to absolute temperature voltage reference $V_{NTAT}$, or another band gap reference. The controlled current output $I_{OUT}$ is controlled by the ratio of the $V_B$ to $V_A$.

Those skilled in the art will recognize improvements and modifications to the embodiments of the present disclosure. All such improvements and modifications are considered within the scope of the concepts disclosed herein and the claims that follow.

What is claimed is:

1. A method to provide an analog multiplier comprising:

generating a reference current, wherein the reference current passes through a first element;

controlling a first voltage generated across the first element to set a resistance of the first element based upon a first input voltage, wherein the resistance of the first element includes a drain-to-source resistance of a first transistor and a resistance of a first resistor;

controlling a resistance of a second element to be substantially proportional to the resistance of the first element, wherein the resistance of the second element includes a drain-to-source resistance of a second transistor and a resistance of a second resistor; and controlling a second voltage generated across the second element to generate a current passing through a third element based upon a second input voltage.

2. The method of claim 1 further comprising:

mirroring the current passing through the one of the second element and the third element to generate an output current proportional to the reference current multiplied by a ratio of the second voltage divided by the first voltage.

3. The method of claim 1 further comprising:

mirroring the current passing through the third element to generate an output current proportional to the reference current multiplied by a ratio of the second voltage divided by the first voltage.

4. The method of claim 1 wherein controlling the first voltage generated across the first element to set the resistance of the first element comprises:

receiving the first input voltage at an operational amplifier;

controlling, with the operational amplifier, the first voltage generated across the first element based upon the first input voltage.

5. The method of claim 4 further comprising:

generating the first input voltage based upon a band gap reference voltage.

6. The method of claim 5 wherein the operational amplifier is a first operational amplifier, and wherein controlling the second voltage generated across the second element to generate the current passing through the third element further comprises:

receiving the second input voltage at a second operational amplifier, wherein the second operational amplifier is configured to control the second voltage generated across the second element;

generating the second input voltage based upon a voltage ramp signal used to control a radio frequency power amplifier;

generating an output current through a fourth element based upon the current passing through the third element; and providing the output current from the fourth element to the radio frequency power amplifier.

7. The method of claim 5 wherein the operational amplifier is a first operational amplifier, wherein controlling a second voltage generated across the second element to generate a current passing through a third element further comprises:

receiving a second input voltage at a second operational amplifier, wherein the operational amplifier is configured to control the second voltage generated across the second element; and wherein the second input voltage is one of a proportional to absolute temperature voltage source and an inversely proportional to absolute temperature voltage source.

8. The method of claim 1 wherein the resistance of the first element is substantially equal to the resistance of the second element.

9. The method of claim 1 wherein a ratio of a channel length to a channel width of the second transistor is proportional to a ratio of a channel length to a channel width of the first transistor.

10. The method of claim 9 wherein the ratio of the channel length to the channel width of the first transistor is smaller than the ratio of the channel length to channel width of the second transistor by a factor n.

11. The method of claim 10 wherein the resistance of the second resistor is substantially equal to n times the resistance of the first resistor.

12. The method of claim 1 wherein the first transistor and the second transistor are configured to operate in a triode mode; and further wherein a ratio of a channel length to a channel width of the second transistor is proportional to a ratio of a channel length to a channel width of the first transistor.

13. The method of claim 12 wherein the resistance of the second element is substantially equal to the resistance of the first element.

14. The method of claim 1 wherein the first transistor and the second transistor are configured to operate in a triode mode; and further wherein a ratio of a channel length to a channel width of the second transistor is substantially equal to a ratio of a channel length to a channel width of the first transistor.

15. The method of claim 1 further comprising linearizing a relationship between the first voltage generated across the first element and the resistance of the first element.

16. The method of claim 1 further comprising linearizing a relationship between the second voltage generated across the second element and the resistance of the second element.

* * * * *